United States Patent [19]

Dutro

[11] 4,319,695

[45] * Mar. 16, 1982

[54] VENDOR FOR FLAT ARTICLES

[76] Inventor: Lyle V. Dutro, 1908 Meadowbrook, Altadena, Calif. 91001

[ * ] Notice: The portion of the term of this patent subsequent to Aug. 12, 1997, has been disclaimed.

[21] Appl. No.: 127,048

[22] Filed: Mar. 4, 1980

Related U.S. Application Data

[63] Continuation-in-part of Ser. No. 864,773, Dec. 27, 1977, Pat. No. 4,216,877.

[51] Int. Cl.[3] ..... B65H 5/16

[52] U.S. Cl. ..... 221/213; 271/18.3

[58] Field of Search ..... 221/213–216, 221/227, 231, 232, 236, 238, 225, 210, 211, 226, 230; 271/18.3, 21, 22, 95, 84

[56] References Cited

U.S. PATENT DOCUMENTS 4,216,877 8/1980 Dutro ..... 221/213

*Primary Examiner*—Stanley H. Tollberg

*Attorney, Agent, or Firm*—Donald D. Mon

[57] ABSTRACT

A vendor issuing a single article at a time from a stack of flat articles such as newspapers or magazines. The vendor has a separator to peel an edge of the end article off the stack, a conveyer to be inserted between the peeled edge and the subsequent article, and ejector structure to aid in issuing the article after it is released at least partially to rest on the conveyer. A coin release enables an actuator such as a handle to operate the vendor only after proper coinage has been supplied.

27 Claims, 16 Drawing Figures

20
21
66
45
62
60
59
65
61
47
76
67
68
41a
40
56
58
75
55
70
47
41
71
57
46
50
63
54
77
31
64
52
51
53
35
37
38
39
36

VENDOR FOR FLAT ARTICLES

CROSS REFERENCE FOR COPENDING APPLICATION

This is a continuation-in-part of applicant's presently copending patent application Ser. No. 864,773 filed Dec. 27, 1977, entitled "Vendor for Flat Articles and Method of Vending Said Articles", now U.S. Pat. No. 4,216,877, issued Aug. 12, 1980.

FIELD OF THE INVENTION

This invention relates to vendors for dispensing, one at a time, single articles from a stack of such articles, an example being the one-at-a-time vending of newspapers and magazines.

BACKGROUND OF THE INVENTION

The problems of economically dispensing newspapers and magazines have become increasingly serious as the cost of these articles have risen. There was a day when the cost was low enough that people would not bother to pilfer them, or if they did the economic loss was tolerable. However that is no longer the situation, and the use of more reliable vending means has become necessary. There are known devices where insertion of the proper number of coins gives access to the stack of articles. The customer is relied on to take only one. This is proving to be a less reliable assumption as the cost of the articles has increased. Accordingly, there is now a serious need for an economical and reliable device which will without supervision dispense only one article at a time, and which will not give the customer access to the stack.

There have been vending devices for the purpose of feeding or vending articles one at a time, and one such device is shown in Dutro U.S. Pat. No. 3,934,754, issued Jan. 27, 1976, entitled "Device for Issuing Single Units of Flat Flexible Articles." Also, there is in the vending art a class of device known as a "feeder" wherein an end member is peeled from the stack. Such a feeder is shown in Dutro U.S. Pat. No. 3,384,366, issued May 21, 1968, entitled "Outfeed Mechanism." Both of the foregoing devices, while effective, still have limitations by way of complicated structure, excessive length of travel path for the article being dispensed, and uncertainty of delivery.

In an effort to overcome the above disadvantages, a vendor has been developed such as shown in the aforesaid Dutro U.S. patent application Ser. No. 864,773. This is an effective and reliable device but suffers from limited stack capacity, and too limited article size and bulk. A newspaper vendor for sidewalk use must be rugged enough to withstand abuse, must be loadable quickly and conveniently, must be economically affordable, and must have a minimal height and width. The reason for this latter requirement is that newspaper racks are generally placed as modular widths in an installation and often face legal height limitations. In general their widths are determined by the largest width of the newspapers being sold in that vicinity plus only a minor additional width to accommodate a surrounding enclosure such as a simple hinged cover and appurtenant mechanisms. A device according to this invention utilizes a substantial mechanism which projects from both sides of the stack of newspapers. Accordingly it is desirable to provide mechanisms which themselves occupy as little frontal width and height as possible.

It is an object of this invention to provide a vendor which accomplishes the foregoing objectives.

BRIEF DESCRIPTION OF THE INVENTION

A vendor according to this invention is fitted inside a surrounding cabinet which denies access to a stack of articles except through a door through which the vendor is loaded. The cabinet has a slot through which the vended article is ejected only after the article is paid for. The vendor includes an actuator section which has a handle available to the purchaser of the article. The vendor includes coin release means which will prevent actuation by the handle except after payment of a predetermined amount of money. The actuator section is provided with means which prevent repetitive operation without the handle's having returned to the locked condition and another payment having been made. The vendor further includes an elevator section which is readily depressed by the person loading the machine and which each time an article is to be dispensed raises the stack so that the uppermost surface of the topmost article in the stack is disposed at a datum elevation. This enables articles of different thicknesses to be dispensed or even intermixed and dispensed without adjustment of the machine. The vending section further includes means to lift an edge of the article, a conveyor to be at least partially placed beneath the raised edge, and means for moving the article with the conveyor so as to eject the article through the slot.

The invention will be fully understood from the following detailed description and the accompanying drawings, in which.

Figure 1:
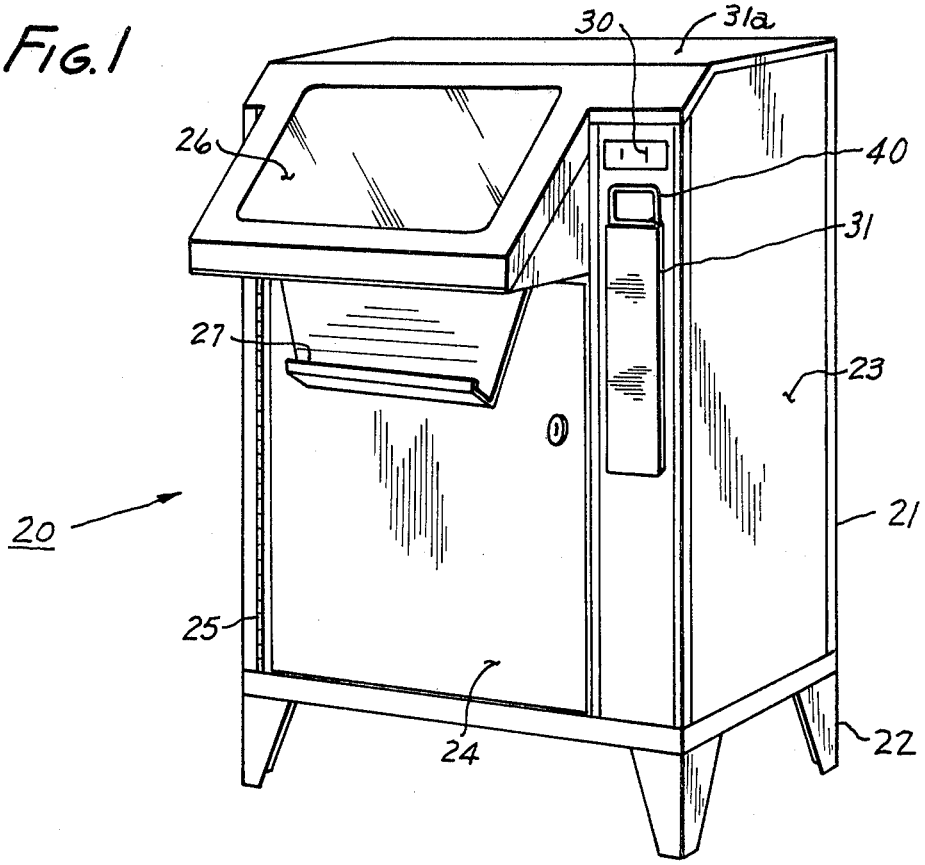
FIG. 1 is a perspective view of a vendor according to the invention, as seen by customers.

FIG. 1 shows a vendor 20 according to the invention. The vendor includes a frame 21 having legs 22, sides panels 23 and a lockable door 24 mounted by a piano hinge 25 to the front of the structure. A window 26 provides a visual access to a top (last) article representative of items on a stack which are to be sold one-by-one. A tray 27 catches the vended article which will be issued through a slot 28 in the front panel. A pivoted plate 29 pivots outwardly to pass the article, but excludes hand or other intrusion. Coin slots 30 are provided at the outside to receive coins which will enable a coin release mechanism to release an actuator handle 31. Handle 31 is the purchaser's only access to the vending mechanism. There is a top 31*a* on the vendor, and of course there will be an internal floor (not shown in FIG. 1).

Conveniently the frame structure may be formed as an open framework formed by appropriate edge members, and the various panels can be slid into it and locked in place. This will provide for optimum structural rigidity, ready repairability, and a minimum envelope size. Such details can be varied by the designer.

Figure 2:
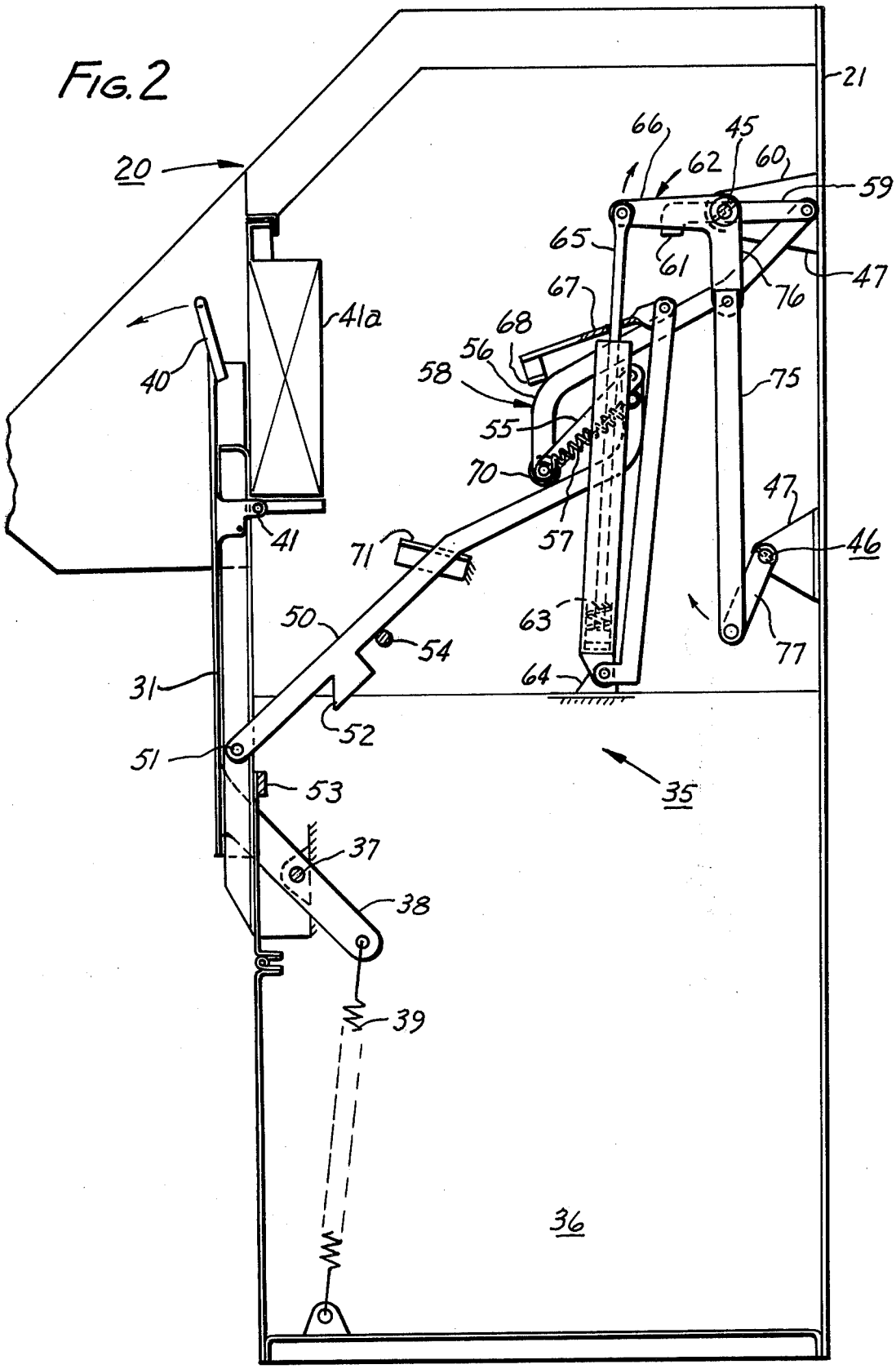
FIG. 2 is a side elevation partly in cutaway cross section showing the actuator section of the vendor of FIG. 1 in the repose condition.
Figure 3:
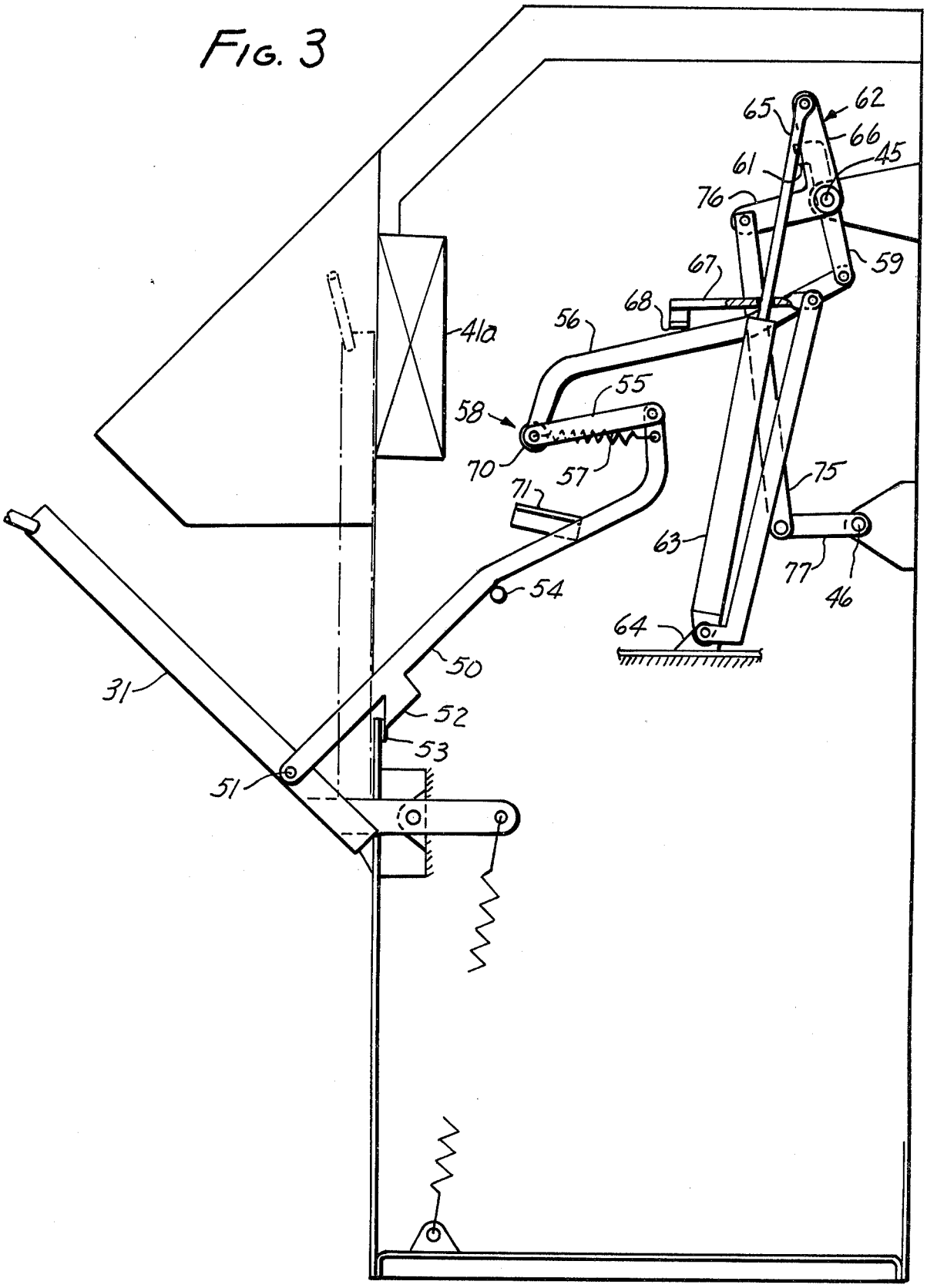
FIG. 3 is a view similar to FIG. 2 showing the actuator system in an actuating sequence.
Figure 4:
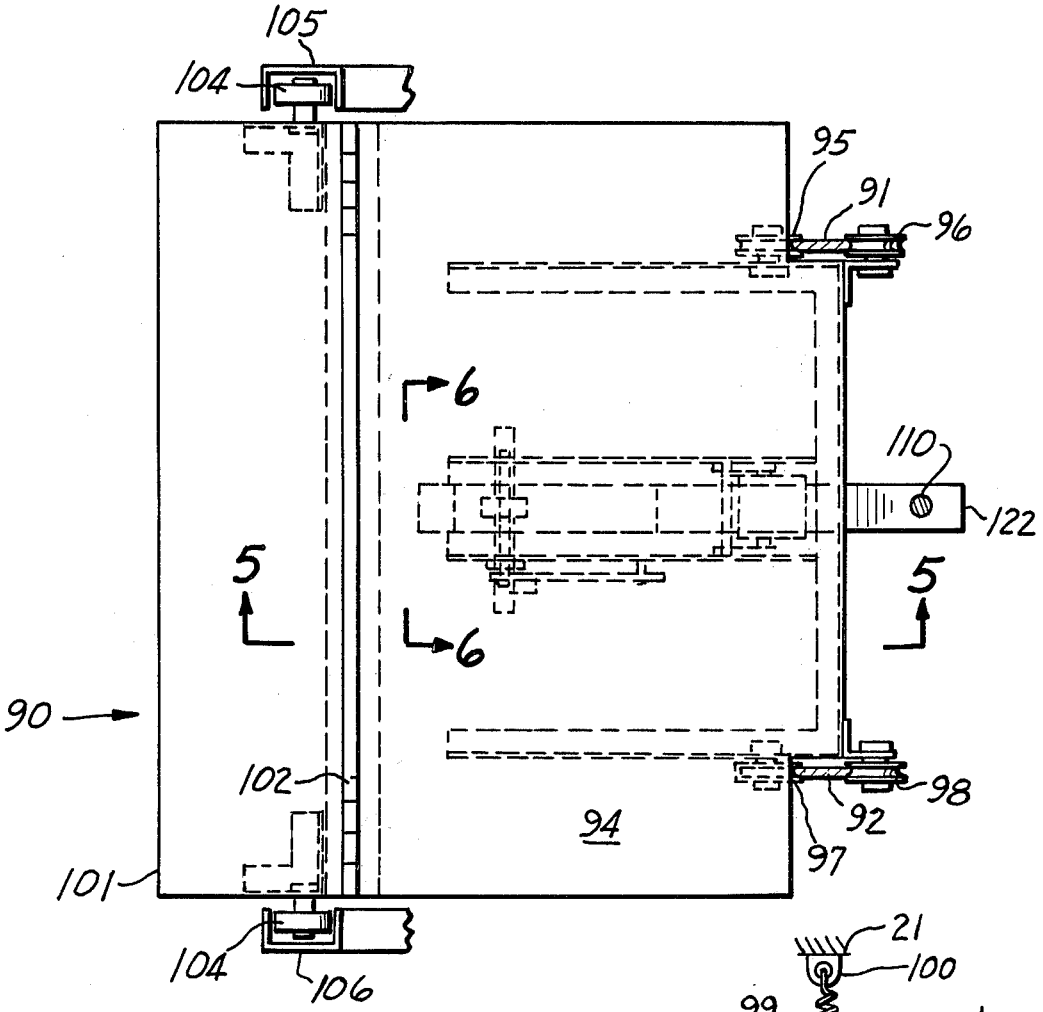
FIG. 4 is a cross-section taken at line 4—4 of FIG. 5.

FIGS. 2 and 3 show the actuator section 35 of the vendor. This section is disposed immediately inside a side panel and to the outside of an internal rigid structural wall member 36 that is adjacent to handle 31. The stack of articles is inside of wall 36, that is, on the opposite side of it from the actuator section. Handle 31 is pivotally mounted to the frame by a hinge 37. The hinge conveniently includes a hinge pin.

The handle includes a rigid lever 38 which is connected to a bias tension spring 39 which spring tends to pull lever 38 downwardly, and the handle itself toward the face of the vendor.

Handle 31 is provided with a hand grip 40 for the user's hand, and a latch 41 which is engageable with a coin release 41*a* which will latch handle 31 to it until and unless correct coinage is inserted in coin slots 30. It will be seen that in the repose condition, handle 31 is locked to the frame in the position shown in FIG. 2 and can only be moved after latch 41 is released. Then it can be pulled toward the position shown in FIG. 3, and released to return and re-latch.

The ultimate purpose of pulling on handle 31, and of the function of the actuator portion is to rotate a first drive shaft 45 and a second drive shaft 46. It is through these shafts, which are rotatably mounted to the frame and to wall 36 by appropriate bearings 47 that the issuing mechanism will operate to issue an article. It is a necessary feature that the actuator portion return to the repose condition shown in FIG. 2 before a subsequent article can be dispensed.

The actuator linkage will now be described in detail. First link 50 is hinge mounted by pin 51 to the actuator handle. It includes a limit flange 51 adapted to strike a limit stop 53 on the cabinet to limit the outer most travel of the actuator handle as shown in FIG. 3. First link 50 follows along a roller 54 mounted to the frame. A second link 55 is hingedly mounted to the first link and also to a third link 56. The first and third links have bends which enable the second link to fit between them with an overcenter spring 57 acting to support this assembly in the form of a toggle 58 which is bi-stable. Its first stable position is shown in FIG. 2 and its other stable position is beyond that shown in FIG. 3 as will later be discussed.

A drive link 59 is hingedly pinned to the right hand end of third link 56 in FIGS. 2 and 3. It is rotatably journaled around shaft 45 at journal 60 and is freely rotatable relative thereto. It includes a drive flange 61 which is turned under and in the path of a second drive link 62 which is pinned to first shaft 45. Therefore, shaft 45 can be unidirectionally driven by exertion of clockwise (in FIGS. 2 and 3) force through driven flange 61 as a consequence of rotation of first drive link 59. This rotation is opposed by a return spring member 63 which is mounted to a bearing 64 on the frame and whose shaft 65 is mounted to a lever arm 66 on drive link 62. This will reset the system when the handle is released. A unidirectional lock 67 enables shaft 65 to extend but not to return. This prevents the system from backing up once it is started. Lock 67 has a flange 68 which is struck by link 56 near the end of the stroke, which will pivot, relock and release it until the device is reset.

A toggle-break roller 70 (FIG. 2) is hinged mounted to the joinder between the second and third links 55 and 56. Its function is to encounter striker plate 71 mounted to the cabinet shortly before the position shown in FIG. 3 which will throw the toggle out of its stable condition in FIG. 2 through an unstable position toward the stable FIG. 3 position, afterwhich the system can return to its starting condition.

A transmission link 75 is pinned to flange 76 on the second drive link and is also pinned to lever 77 that in turn is pinned to second shaft 46. It will now be seen that pulling the actuator handle to the position of FIG. 3 will have caused rotation of both of shafts 45 and 46. The important things about this arrangement are that it cannot occur until after appropriate coinage has been inserted in the coin release mechanism, and that once the actuator handle has been partially pulled it cannot be partially reversed and pulled again to result in multiple issuance of articles after only coinage for only one article has enabled the vendor to operate.

In order to supply articles to be vended, an elevator 90 is provided. It is arranged for vertical reciprocation along a pair of laterally spaced apart vertical rails 91, 92 which are fixed to the frame. The platform includes an understructure 93 to which a horizontal plate 94 is attached. Wheels 95, 96, 97, 98 are provided in pairs on opposite sides of the understructure so as to support the platform against the forces exerted by the weight of the platform and of the articles stacked on it.

The plate is biased in an upward direction by a spring 99 fixed by an anchor 100 to the frame. If preferred, the spring could be anchored instead to the bottom of the frame and the cable run over an upper sheave to exert the upwardly biased force.

Plate 94 includes a lip 101 which is mounted by a piano hinge 102 near its forward edge, lip 101 has a depending finger 103 which carries an idler wheel 104 that rides in a two flange track 105 that adjusts the angle of lip 101 relative to plate 94 as a function of the elevation of the platform. This smooths the movement of the article being dispensed, and compensates for the variable addition to the stack height by the fold. It is the folded edge which is lifted, and this enables each one to be engaged accurately regardless of how many folds may lie in the stack beneath it. The track is provided in two sections 105, 106, one of which is mounted to the frame at each side. The farther down is the platform, the greater should be the dip of this lip.

Figure 5:
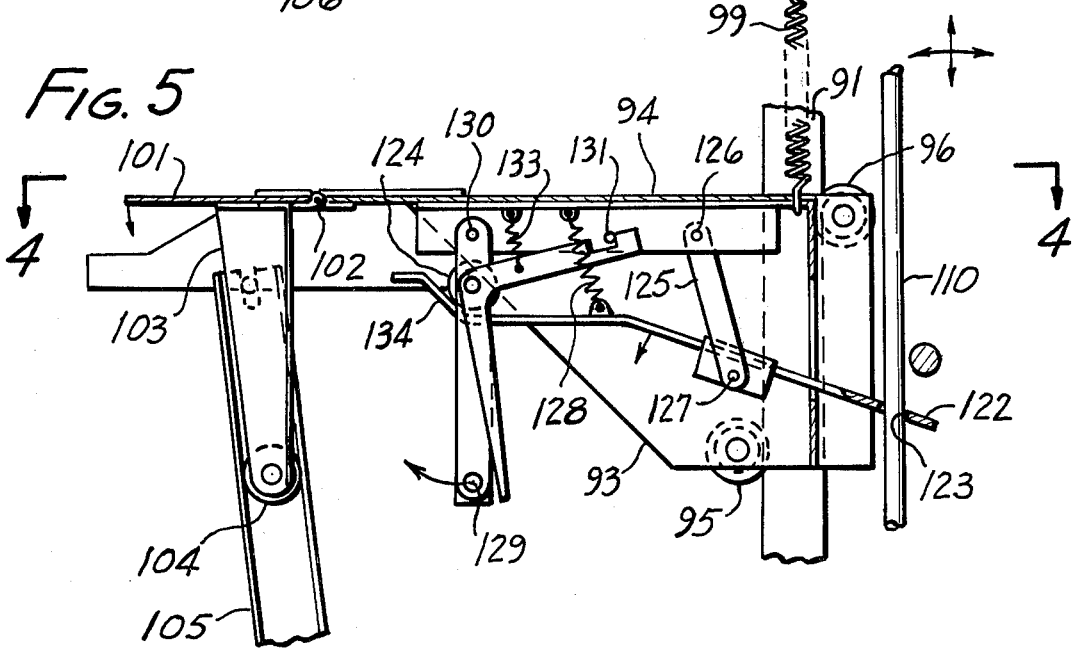
FIG. 5 is a fragmentary cross-section taken at line 5—5 in FIG. 4.

A brake control 110 (see FIG. 14) comprises a vertical rod which is pivotally mounted to the frame at its upper and lower ends by being hinged-mounted to a pair of links 113, 114. Link 113 is pinned to shaft 45 for rotation with it. Link 114 is hinged to an anchor bearing 111 mounted to frame 21. The brake control rod is generally circular in cross-section and is pivotally mounted to the links 113, 114 in an approximate parallelogram construction. Rotation of shaft 45 in FIG. 5 will cause the rod 110 to engage in two types of movement. As shown by the arrows, one is generally up and down, and the other is generally to the left in FIG. 5. This is for the purpose of attending to movement of the platform in a manner yet to be described.

Briefly summarized, the platform is biased upwardly toward a paper level limit stop 120. If the platform is free of all influence except spring 99, the top member of the stack will be brought to bear against limit stop 120. The resulting clamp action may be too strong to be overcome by the expulsion forces that can be exerted on the article. Accordingly, at the time of removal this compressive force should be relieved. Still, because this device is intended to vend articles of any desired thickness (even dispensing articles of mixed thicknesses in the same stack) without adjusting the machine itself, it is necessary each cycle for the next article to be brought up against limit stop 120 to position the article. This of course is accomplished by spring 99. Still, the lowering of the stack must be minimized so that the article is not backed too far below the desired vending level. This is the purpose of the lock means 121 best shown in FIGS. 5 and 6.

Figure 14:
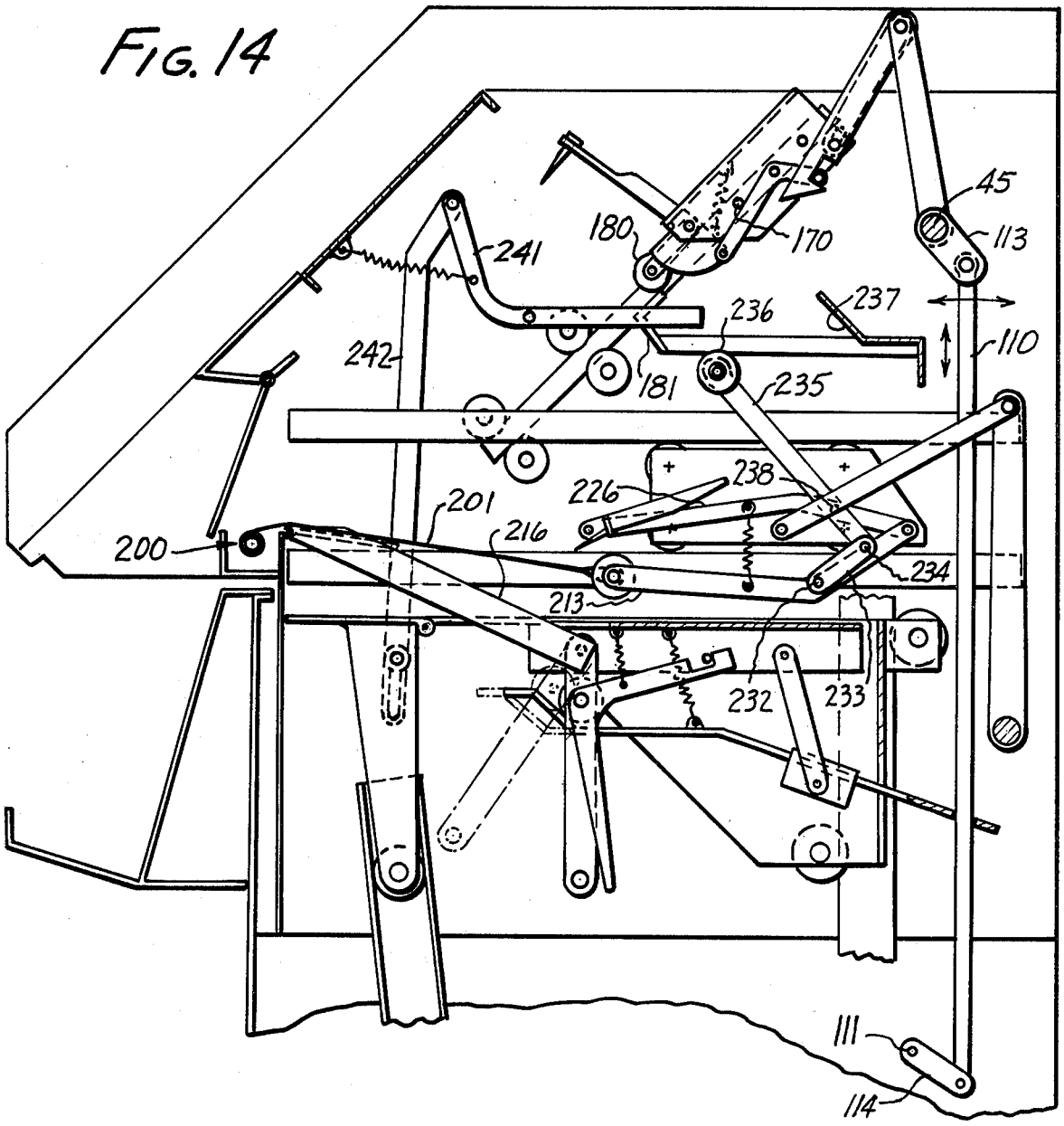
FIG. 14 is a composite assembly view showing the vendor's article-issuing section in an intermediate operating position.

A latch plate 122 is a bent flat plate having an engagement port 123 which passes the rod. It is a function of this type of locking engagement between the wall and edges of port 123, and of the rod, that the rod is able to freely move upwardly because the geometry is unlatching. However, because of the restraint exerted by a restraint wheel 124 under certain circumstances there is the possibility that when the rod moves downwardly it may pull the platform down slightly, but only near the end of the downward movement of the rod. It will be seen that latch plate 122 is mounted to plate 94 by a pivoted link 125, there being pivots at both ends so that the plate is movable in an arc around pin 126 as well as around pin 127. A bias spring 128 (FIGS. 5 and 6) biases the latch plate in the clockwise direction so that it tends to engage restraint wheel 124. The restraint wheel itself is mounted to a handle 129, which handle is pivotal around a pin 130. A latch trigger pin 131 is mounted to the understructure of the platform and a trigger 132 is pivotally mounted to the same pin as the restraint wheel. A bias spring 133 biases this trigger toward its locked position. The latch plate 122 has a bend 134 which faces the restraint wheel. In the repose (nonvertical, shown in dashed line) condition this bend is in contact with the restraint wheel. The dashed-line position in FIG. 14 shows a condition where the movement of the rod to left in FIG. 5 has moved the latch plate away from the wheel and this will permit the engagement plate to "float" and there will be a locking engagement with the rod to move the plate down. Therefore, the initial movement of the rod downwardly will not lock to the plate, nor move the platform down. However, when the movement of the rod is sufficiently far to the left, the rod will lock to the plate and will lower the platform the slight amount necessary to release the compression on the stack, just about the time the expulsion of the article is to occur.

Figure 6:
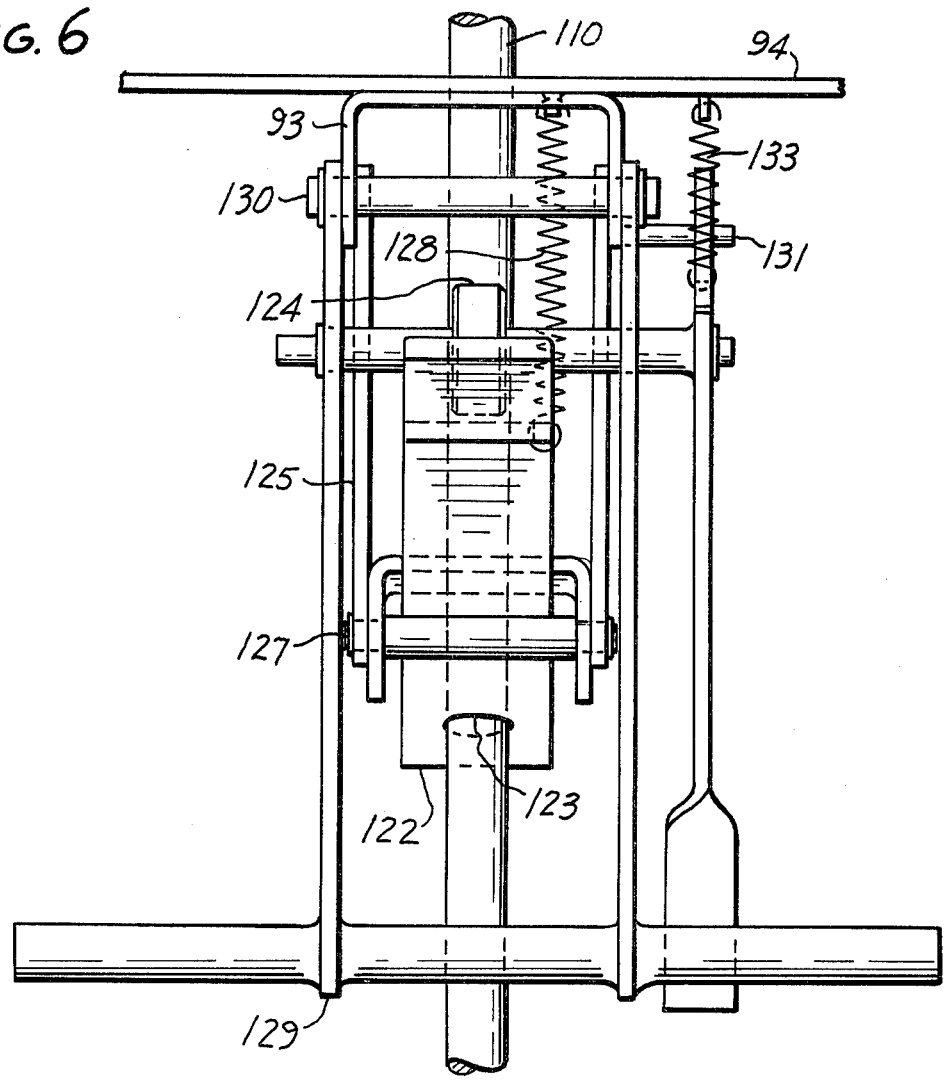
FIG. 6 is a fragmentary cross-section taken at line 6—6 in FIG. 4.

As best seen in FIG. 6, handle 129 extends on two sides, and enables the operator to reach in and pull down with both hands. He will then lock the handle in the solid line position (locked down) while he loads the platform, then he will pull the trigger to release the engagement with trigger pin 121, the handle will move to the dashed line position, and the elevator will move freely upward until the top surface of the top article in the stack engages limit stop 120. During vending operation, the handle is in the dashed (sloping) position shown in FIG. 14. During loading it is straight down, as shown in solid line.

Figure 7:
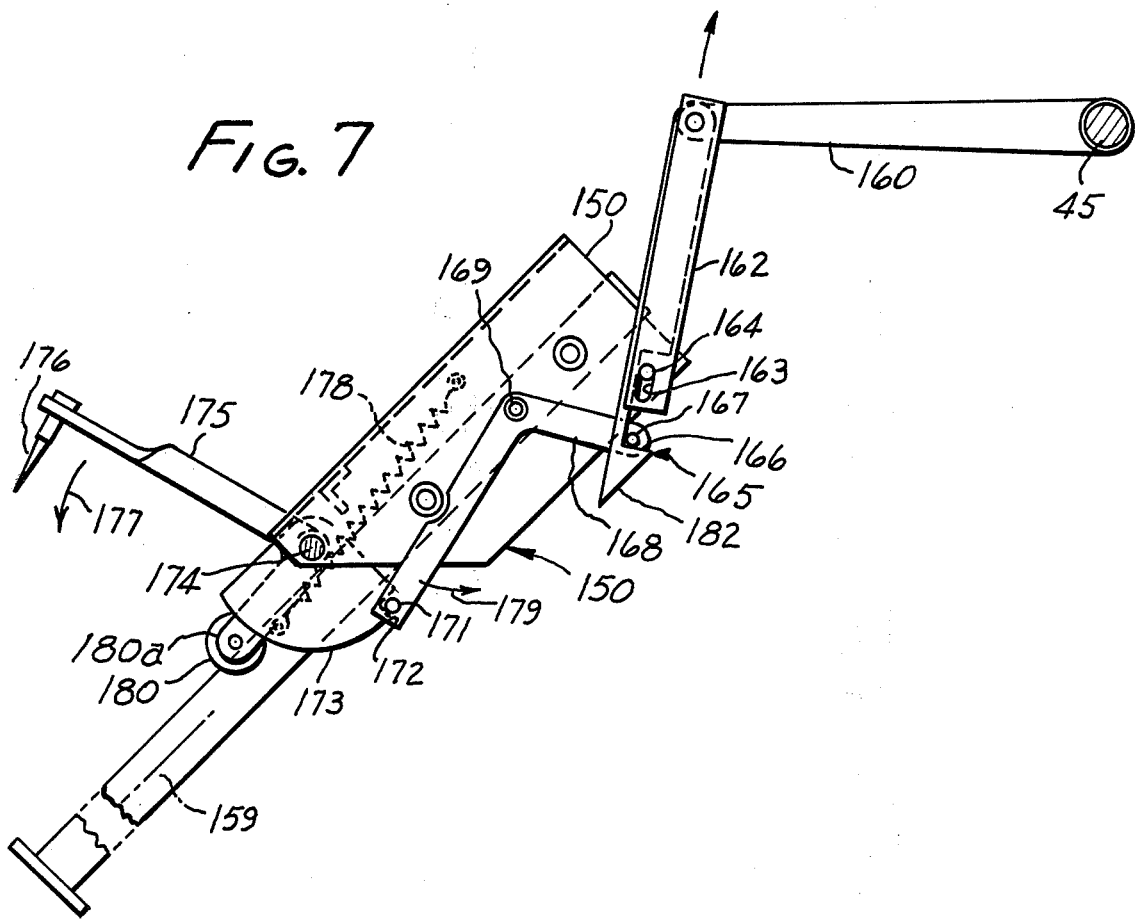
FIG. 7 is a detail view illustrating part of edge-lifting means.

The equipment described to this point provides for actuation of the device by force exerted on handle 31, and the loading of the articles. It is now necessary to describe the means whereby the article is manipulated to issue it from the vendor. FIG. 7 shows in isolated detail one of a pair of carriages 150, 151 located at opposite sides of the device. The carriages are mirror images of one another, so only carriage 150 will be described in detail. However certain latching and control means need not be duplicated at both sides, as will be understood from an examination of the drawings. It is a purpose of these carriages to engage the upper surface of the top article 152 of stack 153 at or near its edge 154. This upper surface is accurately located because the stack has reached and engaged the upper paper limit stop 120.

The carriages respectively ride on tracks 155, 156 which are single rails engaged on opposite sides by opposing sets of wheels 157, 158. Preferably there are four of these wheels in order to provide the carriage with stable guidance. The carriages reciprocate along axis 159 of the tracks. This axis is at acute angle to the top of the stack i.e., relative to the platform.

Figure 8:
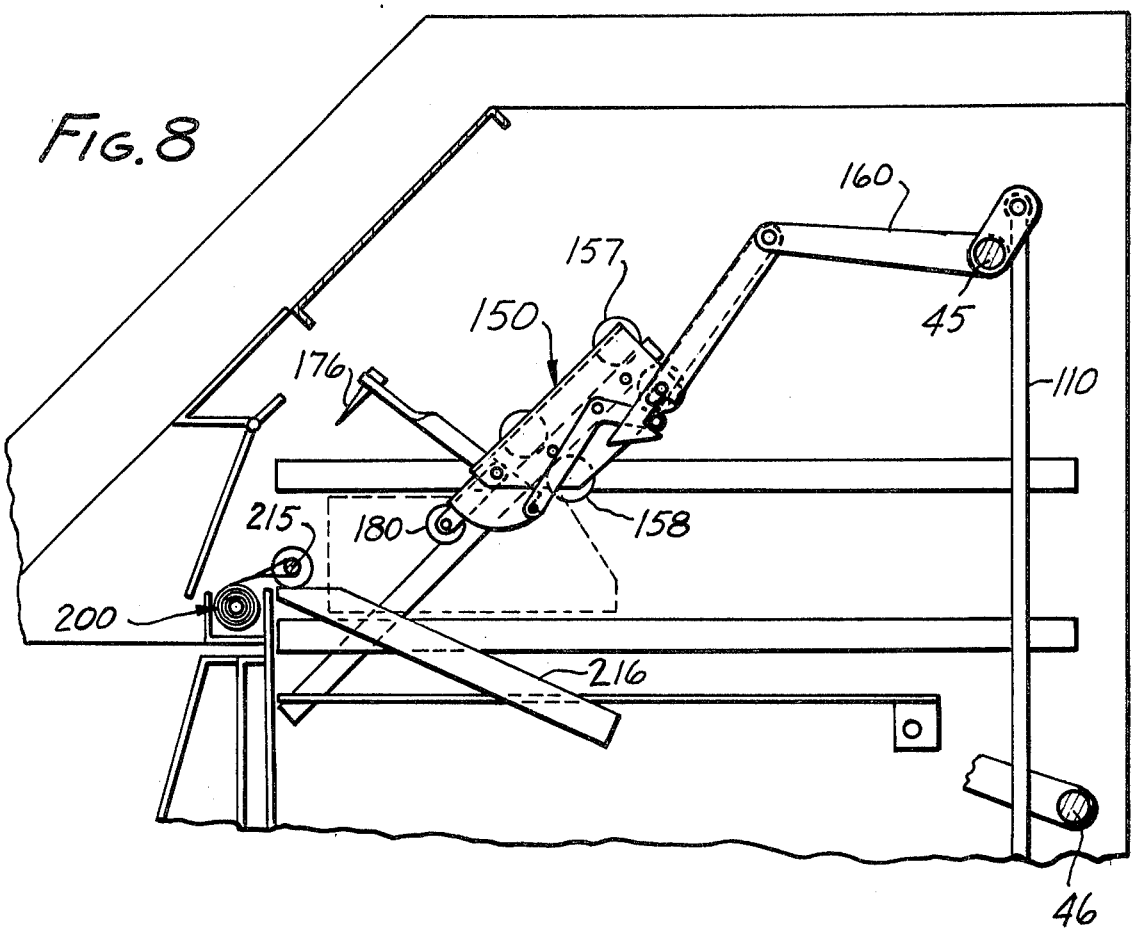
FIG. 8 is a fragmentary section with some parts eliminated for clarity, taken generally at line 8—8 in FIG. 9, with the edge-lifting means in repose.

As can best be seen in FIG. 8, a lever 160 is pinned to first drive shaft 45 so as to be arcuately turned by it. Two members are rotatably pinned to link 160, the first member being a pull strap 162 with a slot 163 therein having a dimension of length adapted to receive and pull against a fixed pin 164 mounted to carriage 150, but with some play. A pull or push on this link will move the carriage and there will be a tolerance of movement between them provided by play in the slot 163. The other member is a trigger 165 which has a trigger face 166 adapted to hook over a trigger pin 167 on a trigger lever 168 that is rotatably pined by pin 169 to the carriage.

Figure 9:
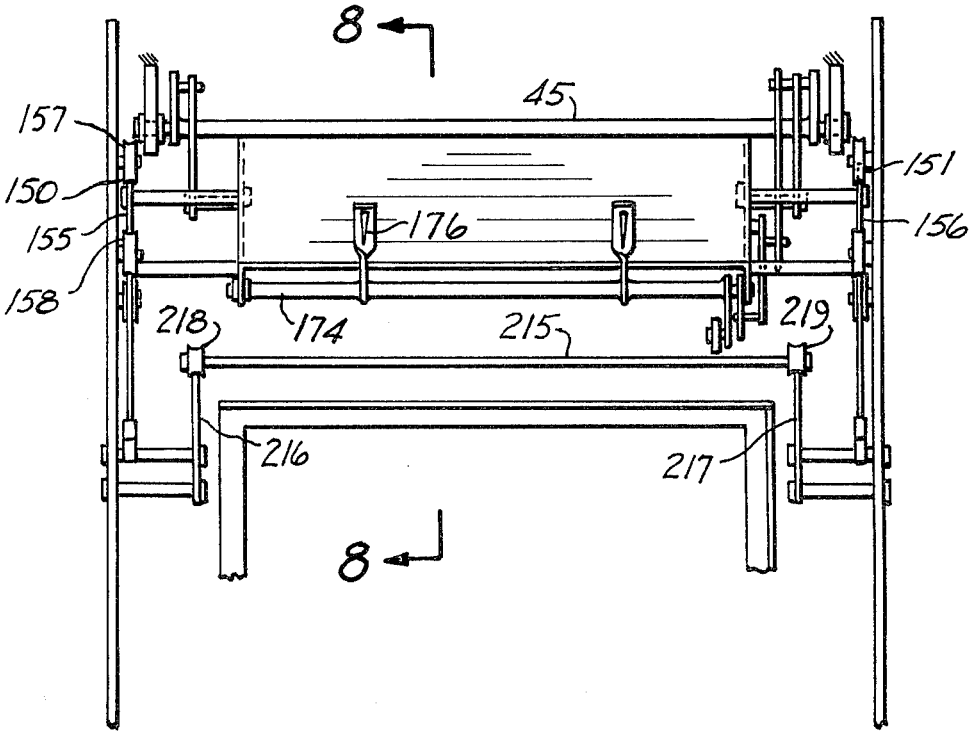
FIG. 9 is is an internal right-hand facing elevation in FIG. 8.

A stop pin 170 (FIG. 14) is mounted to the carriage, and a second trigger pin 171 is mounted to the lever where it can stand in the path of a ratchet face 172 on plate 173. Plate 173 is rotatably mounted to a bearing pin 174 carried by the carriage, and is rigidly connected to a point lever 175 which carries point 176 that is intended to penetrate and engage the top article. Rotation of lever 175 as shown by arrow 177 will rotate the plate. A bias spring 178 biases the ratchet plate and the points in the direction shown by arrow 177 such that the ratchet face 172 tends to bear against trigger pin 171 in the repose condition. When it is moved out of the path by pulling it as shown by arrow 179 the points will be released and will descend to penetrate the top of an article on the stack and "connect" the article to the carriage. It will be seen that the first rotation of the shaft 45 will cause this triggering action to occur, and it will be followed by pulling on the carriage. The result of this movement will be to engage and pull up the top surface of the top member of the stack in a single bend, opening the stack at the edge, as sequentially shown in FIGS. 8 and 9.

A reset wheel 180 is mounted to a lever 180*a* that is also pinned to the point lever or to the plate 173, and is adapted to engage reset stop 181 (FIG. 14) during the latter part of the upward movement of the carriage so as to restore the latched condition. Tapered face 182 on trigger 165 enables the re-engagement to occur. A stop 180*b* on the frame limits the return movement of the carriage.

The foregoing explains the mechanism to engage the article near its leading edge and to lift it. Now it is necessary to describe that portion of the system which brings a conveyor beneath the leading edge of the article so it can be issued.

This mechanism is best shown in FIGS. 12–15. Once the leading edge of the article has been lifted (and it is evident that it is not necessarily lifted at the precise edge, but only near enough that when the lifting action occurs it lifts the front edge), it is desired to put a conveyor beneath it to support the article while it is removed through the slot. It is not necessary to place the conveyor under the entire bottom surface of the article. Usually about one-half, or even less, underlaying will be sufficient.

Figure 12:
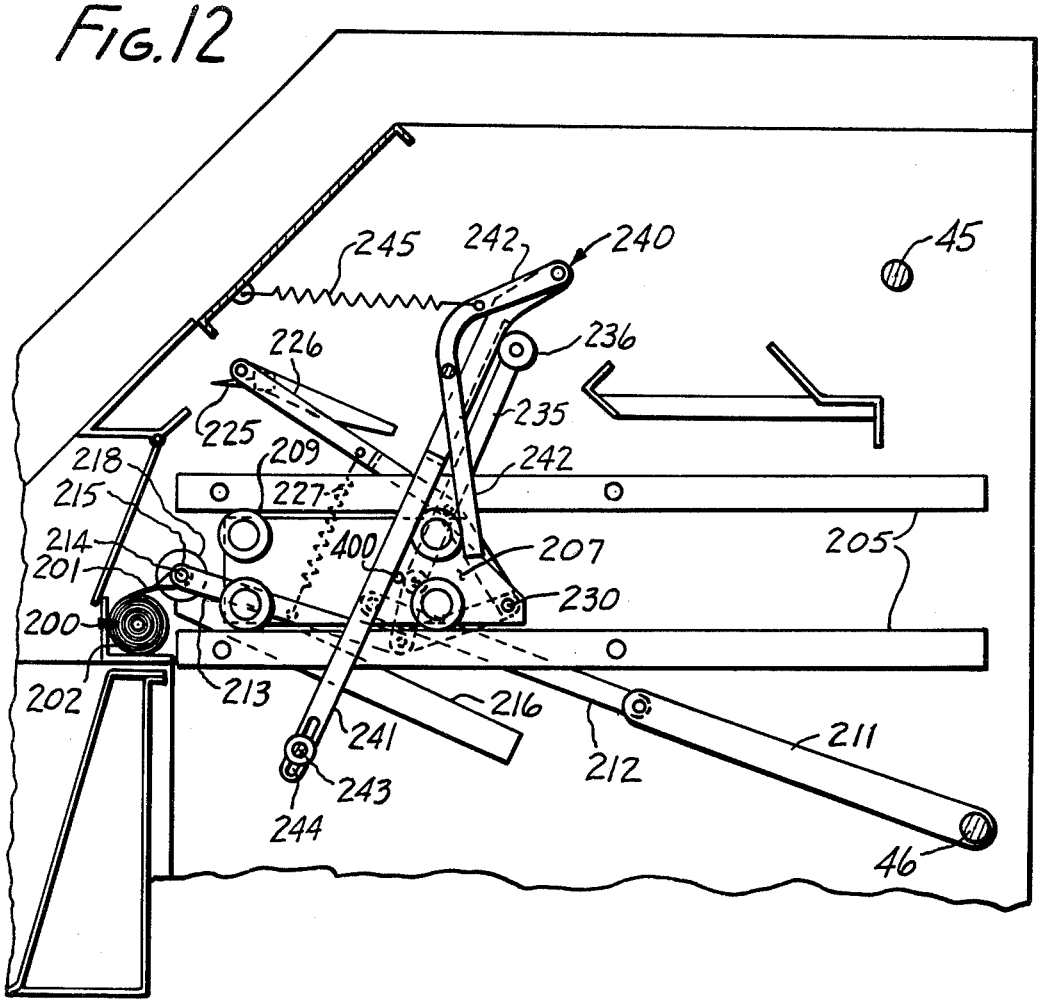
FIG. 12 is a fragmentary section with some parts eliminated for clarity taken generally at line 12—12 in FIG. 13, illustrating conveyor and expulsion means in repose.
Figure 13:
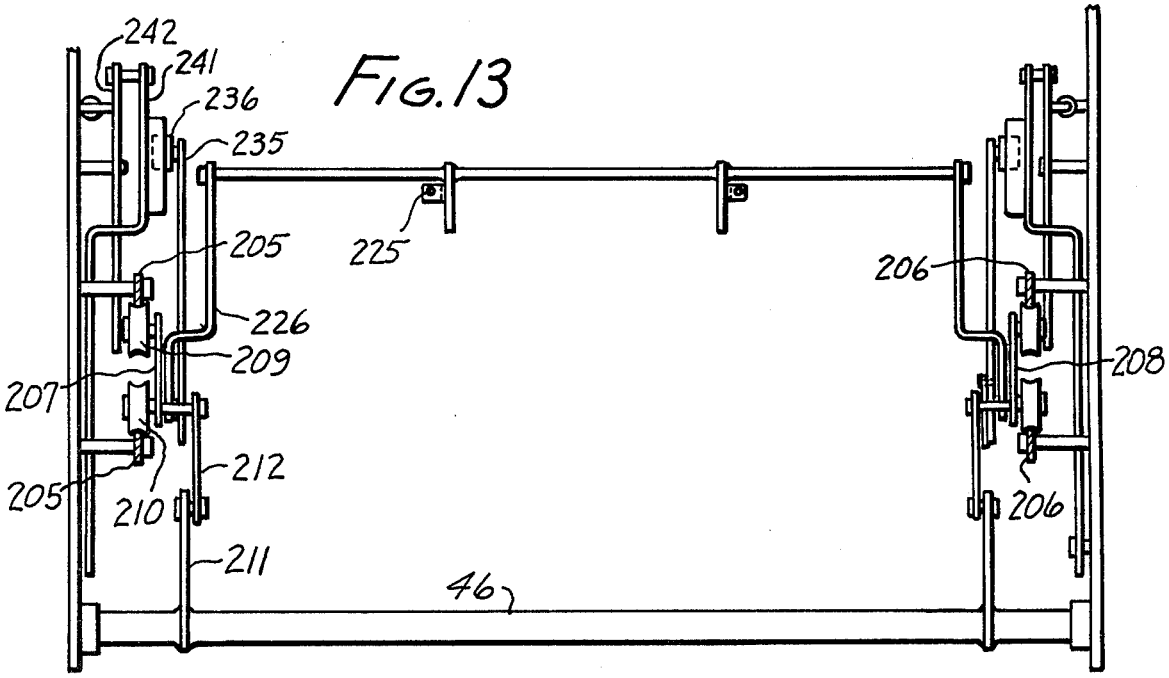
FIG. 13 is an internal right-hand facing elevation in FIG. 12.

A conveyor means 200 is provided preferably as a flexible sheet 201 such as a conventional window shade wound on a spring return roller 202 which extends across at least part of the width of the platform. The spring in the roller is intended to rewind the sheet on the roller, the roller moving in a counterclockwise direction in FIG. 12 for this purpose, and in a clockwise direction to permit the flexible member to unwind. Track sets 205, 206 are provided at opposite sides of the elevator near the top thereof. They are fixed to the frame of the vendor. Trucks 207, 208 ride along the rails, preferably utilizing sets of wheels four in number on each of the trucks. Wheels 209, 210, are examples. Therefore the truck will move horizontally in FIG. 12, generally parallel to the upper surface of the platform. These are duplicated at both sides except for release and reset means which need be provided on only one side. The trucks are driven by a link 211 which is fixed such as by welding or pinning to second drive shaft 46 so as to be rotated by it in the manner best shown by an examination of FIGS. 12–14. FIG. 12 shows the repose condition and FIG. 14 an intermediate position. A second link 212 is pivotally pinned to link 211 and to track sets 205. It will be understood that this arrangement will be duplicated at both sides of the device but only one side will be described in full detail.

A link 213 is pivotally pinned to the truck and supports a rod 214 which extends between another similar link on the other truck to engage the free end 215 of the sheet. Therefore the movement of the truck to the right in FIG. 12 will pull the sheet off of the roller. Because it is desired to issue articles of various thicknesses without having to adjust the machine, it is necessary to cause this sheet to be inserted precisely at the bottom surface of the lifted article. This is enabled by the rotatable nature of links 213. To guide and support these links in their initial movement, there are provided slanted guides 216, 217 fixed to the structure at the opposite sides. Wheels 218, 219 ride atop these guides and remain on them until the rod 214 engages the top of the second article in the stack. At this time it will ride along the surface of that article, and wheels 218 and 219 will leave their guides. Thus, the free end of the conveyor is initially guided downwardly by guides 216, 217 until it engages the top of the next lower article, and then it moves along that article at the precise elevation of the bottom surface of the top article which is to be dispensed. This movement continues to the extent designed into the machine for that purpose.

It is now necessary for the article to be stripped from the points which have lifted it, and then for expulsion point 225 to come into play.

Expulsion points 225 are provided on a lever 226 which is pivotally mounted to the trucks just as the links which support the rod 214, these floating as a scissors assembly on the trucks and being brought together by bias spring 227 extending between them. Stripping is accomplished by a retrograde movement of the structure supporting the expulsion points. As best seen in FIGS. 12–15, the lever 226 is biased by bias spring 227 toward the conveyor means. These are both pivotally mounted to a pin 230 to form said floating scissor construction. The position of the expulsion pins is a fuction of the interaction between several toggle and pin systems. Toggle systems 231 (FIG. 14) is pinned to lever 213 by pin 232 through link 233 to yet another pin 234 to a contactor lever 235. Contactor lever 235 has a contact wheel 236 at its free end adapted at a particular time to strike contactor 237. Lever 235 is joined by pin 238 to lever 226. At opening, this toggle system will spread the free end of the conveyor means and the expulsion pins apart. While moving lever 235 counterclockwise it will cause them to draw together. This is the technique for moving the expulsion points relative to the articles to be dispensed.

Figure 10:
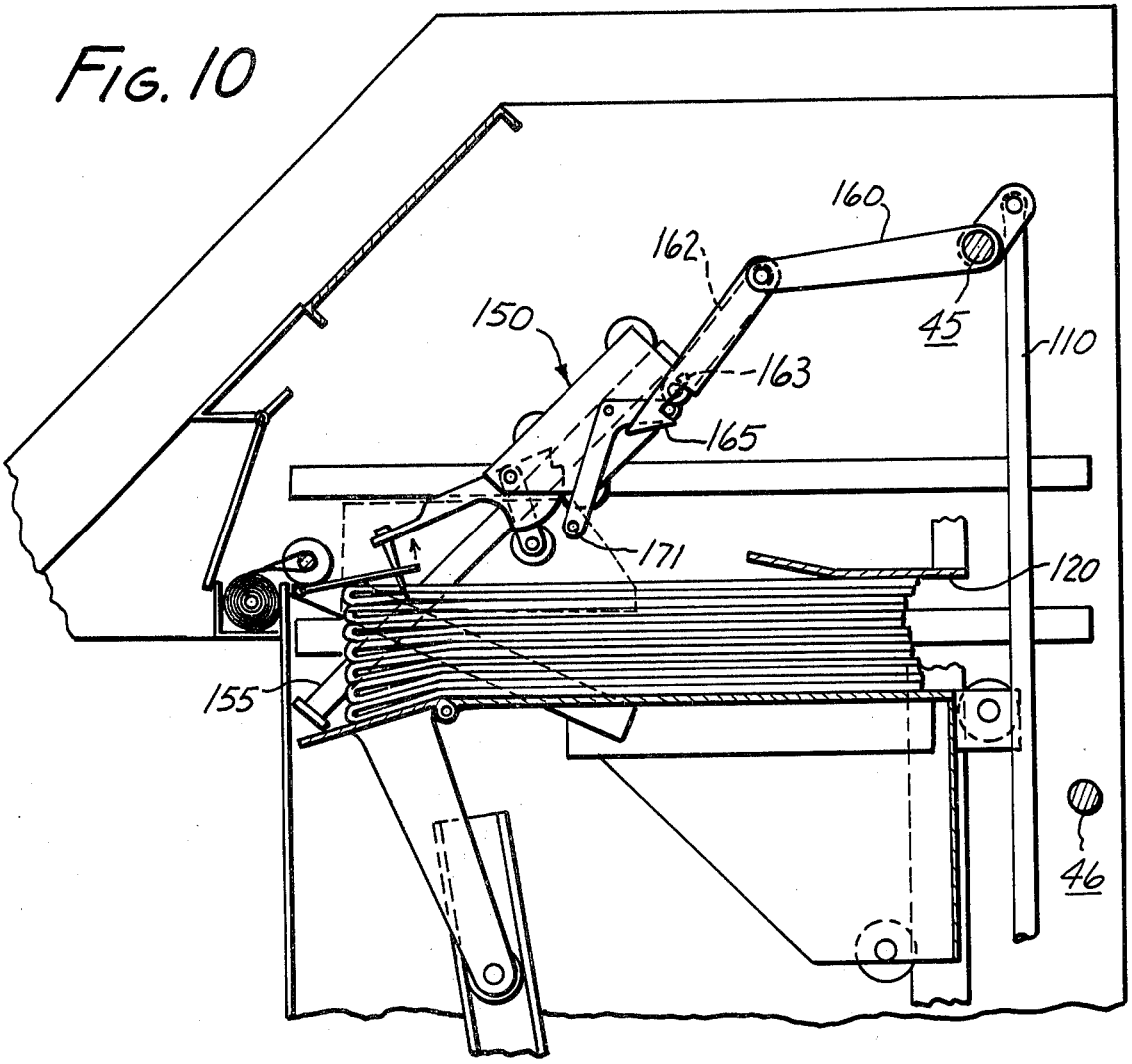
FIGS. 10 and 11 are fragmentary views generally similar to FIG. 8 showing operational positions of the edge-lifting means.
Figure 11:
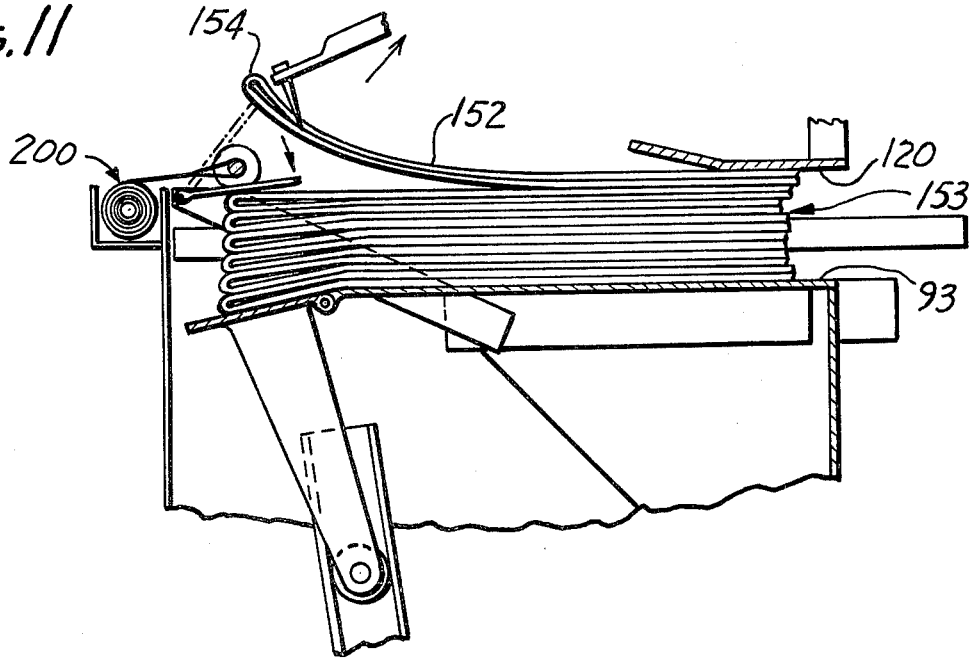

An expulsion reset cam 240 comprises a pair of jointed links 241 and 242, link 241 being restrained by pin 243 in a slot 244 in link 241. A bias spring 245 biases link 242 to the left in FIG. 14. Without engaging in a detailed description of the reactions, when the trucks have been moved sufficiently far to the right in FIGS. 12 and 14 that wheel 236 has struck contactor 237, the toggle system 231 will have snapped over center to the position shown in FIG. 14 and prepared for expulsion. While moving toward their expulsion position, they will strip the article from the points which lifted the edge of the article. In the course of expulsion, the position of FIG. 12 will have again been approached. Pin 400 on returning truck will have reached the position of FIG. 10, and move pivoted lever 242 clockwise to put cam 240, and especially link 241 in the path of the contactor wheel. Thereafter, the contactor wheel will have struck and ridden upon link 241 to cause contactor lever 235 to move to the position shown in FIG. 12 where it will await the next actuation.

Figure 15:
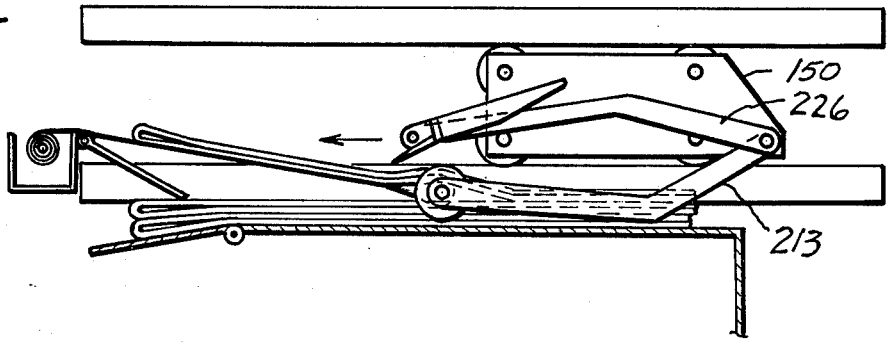
FIG. 15 is a section view showing the conveyor means and expulsion means in an operating position.

The operation of expulsion can be seen in FIG. 15 where the expulsion points are shown biased toward and about to enter the article to be dispensed, thereby after to expell it through the slot. An idler plate 228 rests upon the top of the next subsequent article. The edge of the top article can readily be pulled past this plate when its edge is lifted.

Figure 16:
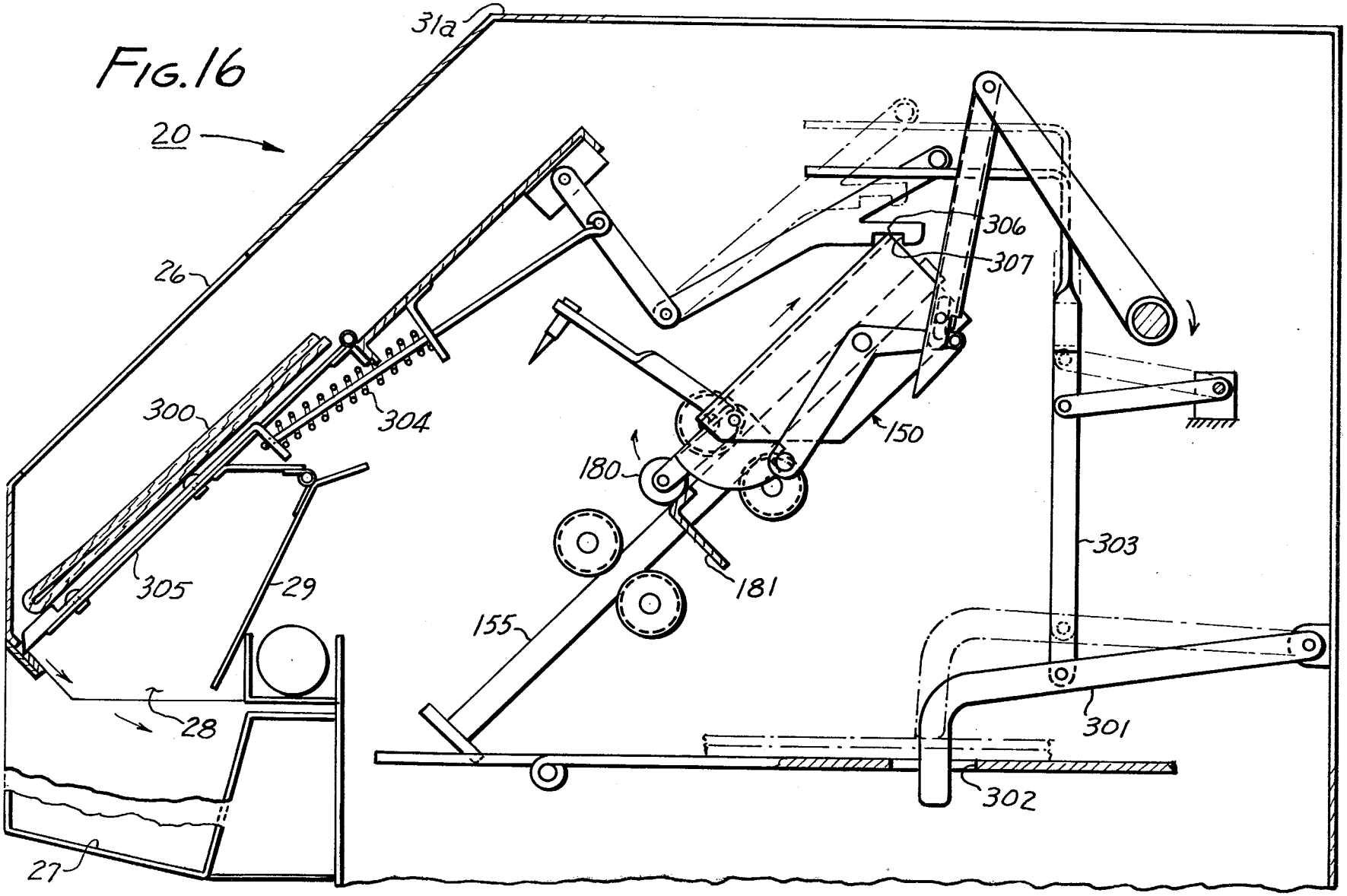
FIG. 16 is a fragmentary cross-section similar to FIG. 8, but additionally showing a last-article issuing means.

The "last article" 300 is carried in a visible location behind window 26 to display what is for sale by the vendor, and to assure that there will always be an article for sale so long as one is visible. When the stack itself is exhausted, the "last article" is sold. A last article detector 301 passes through a hole 302 in the platform and allows the downward movement of a strap 303 in a parallelogram type motion, which upon being engaged by carriage 150 will trip latch 304 to open door 305 and enable the last article to fall out. So long as there is an article on the platform, strap 303 will be held in its upper dashed-line position or positions and there will be no release of latch 304. The release is caused by the axial movement derived from the engagement of the corner 306 of the carriage in a notch 307 as is evident in FIG. 16.

The device as shown has the substantial advantage that it is essentially fool-proof, but certain to deliver an article whenever proper coinage is supplied.

In the actuator section, brake means is provided such that even though the handle can be backed off after being pulled partway out, the linkage itself will be locked against return until the full cycle has been completed. This prevents multiple manipulation for the same coinage, and also prevents repetitive advancing fractional operation. Furthermore, all of the powered operations necessary to issue the article are attended to on the power stroke of the vendor, and only the resetting of the actuator section occurs during the return stroke. Therefore the device is certain in its operation.

To recapitulate the operation, coinage is first placed in the slot to unlatch the coin release mechanism. Then the handle is pulled, which causes rotation of the shafts 45 and 46. These shafts and their outputs are differently timed by the relative proportions and positions of the linkages shown. Initially the points are released to penetrate the top of the article, after which the carriages retract the points upwardly and rearwardly in the vendor to lift the edge of the top article. After this goes on for a specific period, the trucks begin to move and they enter beneath the lifted edge. About this time, the elevator is relieved a trifle to take the compression off the stack, the article is stripped off the points, and the expulsion points engage the article. Then the trucks return toward the slot pushing the article, which is partially supported on the conveyor, and held against it and pushed by the expulsion points. The article moves through the slot. By this time the lifting points have been reset. The expulsion points are set the last thing, and then when the handle is released the sytem all returns to its repose condition. The elevator will move vertically to move the next subsequent article, which is now the top article, against the limit stop, and the procedure can be repeated.

The platform is loaded by pulling handle 129 down and locking it in the vertical position. This locks the platform to rod 110. After the articles are loaded, the trigger is pulled to release handle 129, which moves to its slanted position. The lock is "off," and the stack floats upward to the position defined by engagement of the top article with limit stop 120. Thereafter the lock engages only near the end of the issuance stroke, just enough to relieve compression on the stack to free the top article.

The term "separator means" is sometimes used to describe point 176 and the device which carry them. The term "release means" is sometimes used to describe the means which hold them in one position, and then release them to engage an article. The term "support means" is sometimes used to describe the carriages.

The drawings are in the main generally drawn to scale, and persons skilled in the art can readily construct a device from these drawings although it will be understood that some of the dimensions may be varied from installation to installation for convenience and for timing purposes.

This invention is not to be limited by the embodiments shown in the drawings and described in the description which are given by way of example and not of limitations, but only in accordance with the scope of the appended claims.

I claim:

1. A vendor for dispensing a single flexible, substantially flat article at a time from a stack of said articles, comprising:

a frame;

a platform on said frame for supporting a stack of articles from which an end article is to be dispensed, said end article having a surface with an edge;

separator means comprising an article engaging member movable to a first position in engagement with said end article, and to a second position not in engagement therewith;

release means comprising latch means for holding said article engaging member in said second position, and means for releasing said article engaging member to move to said first position;

support means mounted to said frame supporting said article engaging means for movement which movement has one component extending along said surface and away from said edge, and another component extending away from said surface and away from said edge, whereby to lift said edge of said end article in a peeling type movement from said edge while said article engaging member is in said first position;

conveyor means mounted to said frame and insertable beneath the lifted edge of said end article while part of said article rests on the article next beneath it in the stack, thereafter to convey said end article away from said stack after the article is released by the article-engaging means; and actuator means mounted to said frame which, when permitted to function, releases said latch means to enable said article engaging member to engage said end article adjacent to said edge, move the support means to cause the article engaging member to lift said edge in said peeling-type movement, move the conveyor means past said edge and underneath at least a part of said end article, release said article from said article engaging member, and move said conveyor means with the end article away from the stack.

2. A vendor according to claim 1 in which the frame includes an enclosure for enclosing said stack, said enclosure having an opening through which the said article is issued.

3. A vendor according to claim 1 in which said actuator means comprises a lever, said lever being adapted to be disabled or prevented from movement by coin-actuated means until after coinage of at least a predetermined amount has been supplied.

4. A vendor according to claim 1 in which said support means comprises a track mounted to said frame having an axis extending at an acute angle to said surface of said article, a carriage mounted to said track and reciprocably moveable along said track, said separator means being pivotally mounted to said carriage, bias means biasing said article engaging means toward the said end article, said latch means being interposed between said carriage and said article engaging means, and means to rotate said article engaging means to its second position after said edge of said article has been lifted and said conveyor means inserted beneath it.

5. A vendor according to claim 4 in which said latch means includes a latch release actuable by the actuator means to release the article engaging means to assume its first position.

6. A vendor according to claim 4 in which said conveyor means comprises a flexible member wound on a shaft adjacent to the stack, and in which a second track extends generally parallel to said surface of said article, and a truck is mounted thereto for axial reciprocation along said second track, said flexible member being operatively connected to said truck for being drawn under said end article, or returned to said shaft.

7. A vendor according to claim 5 in which a link is pivoted to said truck and attached to said flexible member, and in which guide means extends downwardly beneath the elevation of said end article, and in which attaching means for connecting said flexible member to said link extends in a direction generally aligned with said edge, and adapted to move along said guide means, whereby movement of said truck away from said edge while said edge is lifted results in the conveyor means descending along said guide until said attachment means reaches the surface of the subsequent article contiguous to said end article, after which it moves along the top of said subsequent article, said attachment member leaving said guide means.

8. A vendor according to claim 6 in which expulsion means is mounted to said truck to engage said end article after when it rests on said conveyor means to assist in the expulsion of said article when said truck is moved in the direction of said edge.

9. A vendor according to claim 8 in which said expulsion means is pivotally mounted to said truck, and in which means is provided to move said expulsion means to make said engagement, and to move them to remain out of engagement while said edge is lifted.

10. A vendor according to claim 9 in which said expulsion means when out of engagement, is positioned above said article, whereby when said expulsion means is to be engaged to said article it strikes the lifted article to strip it from said article engaging member.

11. A vendor according to claim 10 in which both said link and said flexible member and said expulsion means are pivoted to said truck at a common center of rotation, and in which bias means biases them toward one another.

12. A vendor according to claim 1 in which said actuator means comprises a lever mounted to said frame, and a three-link bi-stable toggle linkage adapted to actuate said vendor in one stable toggle position, and disabled in the other, and means for restoring said toggle linkage to said first position only after said lever has returned to its starting position.

13. A vendor according to claim 1 in which said actuator means includes a return-bias spring system, and releasable lock means enabling the actuator means to issue an article, but preventing the actuator means from reverse movement until after an article has been issued.

14. A vendor according to claim 13 in which said actuator means comprises a lever mounted to said frame, and a three-link bi-stable toggle linkage adapted to actuate said vendor in one stable toggle position, and disabled in its other said position, and means for restoring said toggle linkage to said first position only after said lever has returned to its starting position.

15. A vendor according to claim 1 in which said platform moves vertically, and in which a limit stop overhangs it to limit the height to which the platform can move the top of the stack, and in which means is provided for lowering the stack to free said end article after the article-engaging means has lifted said edge of the end article.

16. A vendor according to claim 15 in which said lowering means includes a rod moveable axially and laterally by said actuator means, and lock means disabled to engage said rod during an initial part of the period of issuance of an article and engageable thereto at a later part.

17. A vendor according to claim 16 in which manual release means is provided to disengage or to engage said lock means, whereby said platform can be lowered and locked to load the same with articles, and thereafter released to rise to engage said limit stop.

18. A vendor according to claim 1 further including last article delivery means, said last article delivery means comprising a compartment with a latched door, said compartment for containing an article to be dispensed only when there is no article on said platform, said platform having an aperture so disposed and arranged as to be covered by an article atop it, the said last article delivery means having a trip arm which maintains the door latched closed when resting on an article on the platform, and which moves to be engageable by said carriage during actuation when there is no article on the platform, whereby said door is unlatched as the consequence of driving engagement with said carriage.

19. A vendor according to claim 7 in which said conveyor means comprises a flexible member wound on a shaft adjacent to the stack, and in which a second track extends generally parallel to said surface of said article, and a truck is mounted thereto for axial reciprocation along said second track, said flexible member being operatively connected to said truck for being drawn under said end article, or returned to said shaft.

20. A vendor according to claim 19 in which said explusion means is pivotally mounted to said truck, and in which means is provided to move said expulsion means to make said engagement, and to move them to remain out of engagement while said edge is lifted.

21. A vendor according to claim 20 in which said expulsion means when out of engagement, is positioned above said article, whereby when said expulsion means it to be engaged to said article it strikes the lifted article to strip it from said article engaging member.

22. A vendor according to claim 21 in which both said link and said flexible member and said expulsion means are pivoted to said truck at a common center of rotation, and in which bias means biases them toward one another.

23. A vendor according to claim 21 in which said actuator means comprises a lever mounted to said frame, and a three-link bi-stable toggle linkage adapted to actuate said vendor in one stable toggle position, and disabled in its other said position, and means for restoring said toggle linkage to said first position only after said lever has returned to its starting position.

24. A vendor according to claim 23 in which said actuator means includes a return-bias spring system, and releasable lock means enabling the actuator means to issue an article, but preventing the actuator means from reverse movement until after an article has been issued.

25. A vendor according to claim 24 in which said platform moves vertically, and in which a limit stop overhangs it to limit the height to which the platform can move the top of the stack, and in which means is provided for lowering the stack to free said end article after the article-engaging means has lifted said edge of the end article.

26. A vendor according to claim 25 in which said lowering means includes a rod moveable axially and laterally by said actuator means, and lock means disabled to engage said rod during an initial part of the period of issuance of an article and engageable thereto at a later part.

27. A vendor according to claim 24 in which said actuator means comprises a lever, said lever being adapted to be disabled or prevented from movement by coin-actuated means until after coinage of at least a predetermined amount has been supplied.

* * * * *